US009115926B2

(12) United States Patent
Rothmund et al.

(10) Patent No.: US 9,115,926 B2
(45) Date of Patent: Aug. 25, 2015

(54) SUBASSEMBLY FOR A REFRIGERATING AND/OR FREEZING APPARATUS, REFRIGERATING AND/OR FREEZING APPARATUS AND PROCESS FOR ASSEMBLY OF A REFRIGERATING AND/OR FREEZING APPARATUS

(75) Inventors: Anton Rothmund, Riedlingen (DE); Klaus Oelmaier, Ochsenhausen (DE); Viktor Laube, Ochsenhausen (DE)

(73) Assignee: LIEBHERR-HAUSGERATE OCHSENHAUSEN GMBH, Ochsenhausen (DE)

( * ) Notice: Subject to any disclaimer, the term of this patent is extended or adjusted under 35 U.S.C. 154(b) by 363 days.

(21) Appl. No.: 12/874,726

(22) Filed: Sep. 2, 2010

(65) Prior Publication Data

US 2011/0067431 A1 Mar. 24, 2011

(30) Foreign Application Priority Data

Sep. 3, 2009 (DE) ..... 10 2009 039 906
Dec. 1, 2009 (DE) ..... 10 2009 056 426

(51) Int. Cl.
*F25D 17/06* (2006.01)
*F24F 7/007* (2006.01)
*F25D 23/00* (2006.01)

(52) U.S. Cl.
CPC ..... *F25D 23/006* (2013.01); *F25D 2323/0021* (2013.01); *F25D 2323/00264* (2013.01); *F25D 2323/00274* (2013.01); *Y10T 29/49826* (2015.01)

(58) Field of Classification Search
CPC ..... F25D 23/006; F25D 2323/00274; F25D 2323/00264; F25D 2323/0021; Y10T 29/49826
USPC ..... 62/455, 291, 411, 419, 428, 314, 414; 454/251, 250, 238, 242
See application file for complete search history.

(56) References Cited

U.S. PATENT DOCUMENTS

| | | | | |
|---|---|---|---|---|
| 1,769,111 | A | 7/1930 | Davenport | |
| 3,785,168 | A * | 1/1974 | Domingorene | 62/455 |
| 4,265,090 | A * | 5/1981 | Abraham | 62/82 |
| 4,498,308 | A * | 2/1985 | Phillips et al. | 62/184 |
| 4,565,071 | A * | 1/1986 | Bartling et al. | 62/89 |

(Continued)

FOREIGN PATENT DOCUMENTS

| | | |
|---|---|---|
| DE | 4445286 | 6/1996 |
| DE | 29701474 | 4/1997 |

(Continued)

OTHER PUBLICATIONS

English abstract of JP 2002-150393 to Wada et al.*

(Continued)

*Primary Examiner* — Mohammad M Ali
(74) *Attorney, Agent, or Firm* — Dilworth & Barrese, LLP

(57) ABSTRACT

The present invention relates to a subassembly for a refrigerating and/or freezing apparatus, wherein the subassembly has at least one air inlet and at least one air outlet, wherein the subassembly is designed in one piece and wherein at least one air guidance device is provided in the subassembly, which is manufactured such that it guides air essentially on a horizontal plane. Moreover, the invention relates to an assembly for a refrigerating and/or freezing apparatus and a process for assembly of a refrigerating and/or freezing apparatus.

20 Claims, 6 Drawing Sheets

(56) References Cited

U.S. PATENT DOCUMENTS

| | | | | |
|---|---|---|---|---|
| 4,628,701 | A * | 12/1986 | Phillips et al. | 62/184 |
| 4,938,034 | A * | 7/1990 | Rosanio et al. | 62/256 |
| 5,117,523 | A * | 6/1992 | Jacobus et al. | 62/259.1 |
| 5,428,973 | A * | 7/1995 | Temmyo et al. | 62/452 |
| 5,499,514 | A * | 3/1996 | Ho | 62/291 |
| 5,502,983 | A * | 4/1996 | Dasher | 62/454 |
| 5,881,567 | A * | 3/1999 | Junge et al. | 62/428 |
| 5,964,101 | A * | 10/1999 | Schulak et al. | 62/430 |
| 6,230,514 | B1 * | 5/2001 | Schulak et al. | 62/434 |
| 6,519,970 | B1 * | 2/2003 | Rafalovich et al. | 62/448 |
| 6,543,250 | B1 * | 4/2003 | Mills et al. | 62/428 |
| 6,701,741 | B2 * | 3/2004 | Liu | 62/429 |
| 7,107,786 | B2 * | 9/2006 | Manole | 62/426 |
| 7,117,928 | B2 * | 10/2006 | Chen | 165/80.3 |
| 7,146,825 | B2 * | 12/2006 | Seo | 62/428 |
| 7,155,926 | B2 * | 1/2007 | Chae et al. | 62/454 |
| 7,228,698 | B2 * | 6/2007 | Sanders | 62/288 |
| 7,493,777 | B2 * | 2/2009 | Kim et al. | 62/353 |
| 7,533,716 | B2 * | 5/2009 | Bianco | 165/124 |
| 7,549,300 | B2 * | 6/2009 | Chun et al. | 62/419 |
| 7,987,684 | B2 * | 8/2011 | Jeong et al. | 62/407 |
| 2004/0139762 | A1 * | 7/2004 | Seo | 62/428 |
| 2004/0163408 | A1 * | 8/2004 | Kim et al. | 62/428 |
| 2004/0221611 | A1 * | 11/2004 | Shin et al. | 62/508 |
| 2005/0160760 | A1 * | 7/2005 | Chae et al. | 62/454 |
| 2005/0178139 | A1 * | 8/2005 | Kim | 62/277 |

FOREIGN PATENT DOCUMENTS

| | | | |
|---|---|---|---|
| EP | 0190794 | | 8/1986 |
| EP | 0444451 | | 9/1991 |
| EP | 0444461 | | 9/1991 |
| EP | 0650680 | | 12/1997 |
| EP | 1972873 | | 9/2008 |
| JP | 2002-150393 | * | 5/2002 |
| JP | 2003222462 | | 8/2003 |

OTHER PUBLICATIONS

Enlish translation of JP 2002-150393 to Wada et al.*

European Search Report mailed May 28, 2015.

* cited by examiner

SUBASSEMBLY FOR A REFRIGERATING AND/OR FREEZING APPARATUS, REFRIGERATING AND/OR FREEZING APPARATUS AND PROCESS FOR ASSEMBLY OF A REFRIGERATING AND/OR FREEZING APPARATUS

BACKGROUND OF THE INVENTION

The present invention relates to a subassembly for a refrigerating and/or freezing apparatus, a refrigerating and/or freezing apparatus, and a process for assembly of a refrigerating and/or freezing apparatus.

In refrigerating apparatuses in which the refrigeration unit, fan and condenser are arranged in the device base, a so-called subassembly is usually formed that is then screwed into the apparatus housing or the body that is already foam-filled. This is relatively complex because the relatively heavy subassembly must be screwed into the apparatus housing which is already foam-filled.

A further disadvantage is that this device has a so-called horizontal air flow, i.e., in these devices, there is an abrupt change in the air flow direction caused partially by a baffle plate that causes a forced deflection of the inflowing air in the vertical direction. This causes an uneven flow through the condenser and an uneven cool air load on the compressor. Furthermore, flow losses are caused by the fact that an unguided deflection of up to 180° occurs from the fan through the condenser past the compressor and to the front-side air outlet. The heat exchange is thus rather ineffective.

A refrigerating apparatus is known from DE 297 01 474 U1 consisting of a device base with a broad air inlet channel and a broad air outlet channel arranged parallel thereto. On the air inlet side, the inflowing air is, however, deflected in a Z shape, i.e., the air in a first horizontal level flows in through the front panel, is then abruptly deflected over a deflection wall into a second horizontal level and then fed through the device base on this second horizontal level. The air outlet from the device base also occurs after a Z-shaped deflection so that this device base has a horizontal air flow which is, as previously indicated above, disadvantageous due to flow losses.

EP 0 650 680 B1 discloses a base for a built-in refrigerating apparatus which is placed on mounting rails with leveling feet and is arranged in a furniture niche. This base is formed like a tray and does not have a separate air flow so that the frontside inflowing air for refrigerating purposes is also swirled when flowing through the base and thus high flow losses are created.

A device base with cool air flow-through is also known from DE 44 45 286 A1 that guides the air through the base labyrinth-style. Substantial flow losses are also caused by these multiple deflections, which losses generally must be compensated for by increased fan rotation.

A device base is known from EP 0 444 461 A2 in which the air is guided from one side of the base through an inlet channel into the machinery compartment, then without further guidance, the air flows through the machinery compartment with a bend of 90° and then leaves the device base through the air outlet channel with a bend of another 90°.

SUMMARY OF THE INVENTION

The present invention thus relates to improving a subassembly of the type stated at the beginning in an advantageous manner, particularly in that the subassembly will be easy to build, will provide improved flow guidance and will preferably be easy to assemble.

This task is solved according to the invention by a subassembly with the characteristics herein. According to this description, provision is made for a subassembly for a refrigerating and/or freezing apparatus to have at least one air inlet and at least one air outlet, where the subassembly is designed in one piece and where at least one air guidance device is provided in the subassembly, which is manufactured such that it guides air essentially on a horizontal plane. The subassembly thus advantageously has vertical air guidance since the air in the subassembly can be guided essentially on one horizontal plane. Vertical air guidance is particularly advantageous since the flow losses are low based on the lack of deflection in a vertical direction. The one-piece design of the subassembly results in particularly simple handling and production of the subassembly.

Furthermore, it is possible that by means of the air guidance device in the subassembly air can be guided without an abrupt change in direction from the air inlet to the air outlet and/or the deviation of the air guidance from the horizontal plane is not more than ±30°, and preferably not more than ±15°. It is particularly advantageously when the air is guided without abrupt change in direction into or through the subassembly. The flow losses can thus be kept low. A deviation in the air guidance from the horizontal plane can also consist in an expansion of the air flow. It is possible that the air guidance device has a first horizontal wall, such as a ceiling or floor, and a second wall running at an angle thereto, or a ceiling or a floor that encloses an angle of not more than ±30° with the horizontal plane, and preferably not more than ±15°.

It is also possible for the air guidance device to be arranged at least in part on the edge of the subassembly. For example, the air guidance device can be arranged in the side area of the subassembly, on the edge, whereby the middle area of the subassembly can remain free or be otherwise used. Moreover, this results in the advantage that with the respective arrangement on the edge of the parts of the air guidance device in the side area of the assembly connecting to the air inlet and air outlet, the inflowing and outflowing air flow can enter or exit on the front side with a maximum distance between them.

Provision can be made for the subassembly to have a recess for acceptance and/or fastening of the inner receptacle of the refrigerating and/or freezing apparatus. This enables simple assembly of the subassembly with the inner receptacle. Because the recess can be used as an adhesive surface that grips a portion of the inner receptacle and by filling with thermal insulating material, the insulating foam is preferably adhered to the inner receptacle. The screwing of the subassembly into the device housing previously foam-filled can thus be done away with, and the assembling of the subassembly with the inner receptacle and the outside wall is made simple by the foaming which must be undertaken in any event.

It is preferable for the recess to be arranged in the middle or center and/or for the recess to be formed in the shape of a tray on the top side of the subassembly. This results in the advantage that the inner receptacle can be placed simply in the recess, possibly with spacers, for positioning in preparation for assembly. Foam is injected advantageously into the area between the recess and the inner receptacle, which is preferably in a form adapted to the shape of the recess, so that the subassembly and inner receptacle can be connected together.

It is also possible for the air guidance device to expand into an accommodating space for at least one compressor, at least one fan and at least one condenser, where fasteners, particularly fasteners for the compressor, fan and condenser, are provided in the accommodating space. The accommodating space can further advantageously consist of air guidance walls that surround the components of the cooling circuit of the refrigerating and/or freezing apparatus in the accommodating space.

Provision can be made for the fasteners for the condenser, fan and compressor to be arranged one after the other in the direction of the flow.

It is further possible for the air guidance device to extend starting laterally from the air inlet past the recess over the accommodating space located in the back area of the subassembly, again laterally past the recess to the air outlet.

Moreover, provision can be made for the air guidance device to be formed in the shape of a channel and/or for the air guidance device to have, at least in sections, a round, oval or rectangular cross-section.

It is further possible that the oval or rectangular cross-section of the air guidance device to be directed vertically. The vertical construction of the oval or rectangular cross-section is preferably achieved by the height of the air guidance device being greater at this location than the width.

Moreover, it is possible for the subassembly to be a device base and/or an injection molded part. Simple and inexpensive production is enabled by the injection molding process. An impact-resistant plastic is preferably used here.

Provision can further be made to provide a condensation water catch tray or an evaporation tray, where the condensation water catch tray or the evaporation tray is arranged in the front area of the subassembly and/or in an area of the subassembly accessible from the front. This results in the advantage that the condensation water catch tray or the evaporation tray is easy to remove and can be emptied. After emptying, it can be re-inserted easily into the subassembly. This is particularly advantageous for health reasons since leaving liquid in the condensation water catch tray or the evaporation tray can thus be avoided.

For example, the condensation water catch tray or the evaporation tray is integrated into the side covering of the subassembly and can be removed and reinserted laterally. Lateral removal for cleaning purposes thus becomes advantageous and simple.

Provision can be made for the subassembly to be built such that the minimum of one condenser can be inserted into the front side. This results in the advantage of being able to create an inexpensive assembly for the condenser since inserting a condenser template through the air inlet or the air outlet in the air guidance channels or the side air guidance channels of the subassembly and assembling it there, e.g., with a positive connection by means of locking will suffice.

Moreover, the invention relates to a refrigerating and/or freezing apparatus with the characteristics herein. According to this description, provision is made for a refrigerating and/or freezing apparatus to have at least one subassembly according to the description herein. The refrigerating and/or freezing device can be a fully-integratable slide-in device that is used in a built-in kitchen. It is further possible that the refrigerating and/or freezing apparatus is a decoratable slide-in device or an integratable compartment device. Its use in stand-alone devices is also possible.

It is further possible that the refrigerating and/or freezing device is a side-by-side device.

Referring to the schematic illustration in FIG. 7, it is particularly advantageous for the refrigerating and/or freezing devices 80 and 90 arranged side by side in a side-by-side device to each have a respective subassembly 10 and for the subassemblies 10 to be formed and/or usable in mirrored fashion.

Moreover, the invention relates to a process for the assembly of a refrigerating and/or freezing apparatus with the characteristics herein. According to this description, provision is made for a subassembly and an inner receptacle of the refrigerating and/or freezing apparatus to be positioned relative to each other in the first step of a process for assembly of a refrigerating and/or freezing apparatus; in a second step, at least one exterior wall of the refrigerating and/or freezing apparatus is positioned relative to the subassembly and inner receptacle, and in a third step, areas or gaps between the subassembly, inner receptacle and exterior wall are foam-filled or back-foamed so that the subassembly, inner receptacle and exterior wall are connected together. This preferably involves a subassembly and/or a refrigerating and/or freezing apparatus according to the description herein.

BRIEF DESCRIPTION OF THE DRAWINGS

The further details and advantages of the invention are explained in greater detail based on an embodiment shown in the drawing.

The figures show.

DESCRIPTION OF THE PREFERRED EMBODIMENTS

Figure 1:
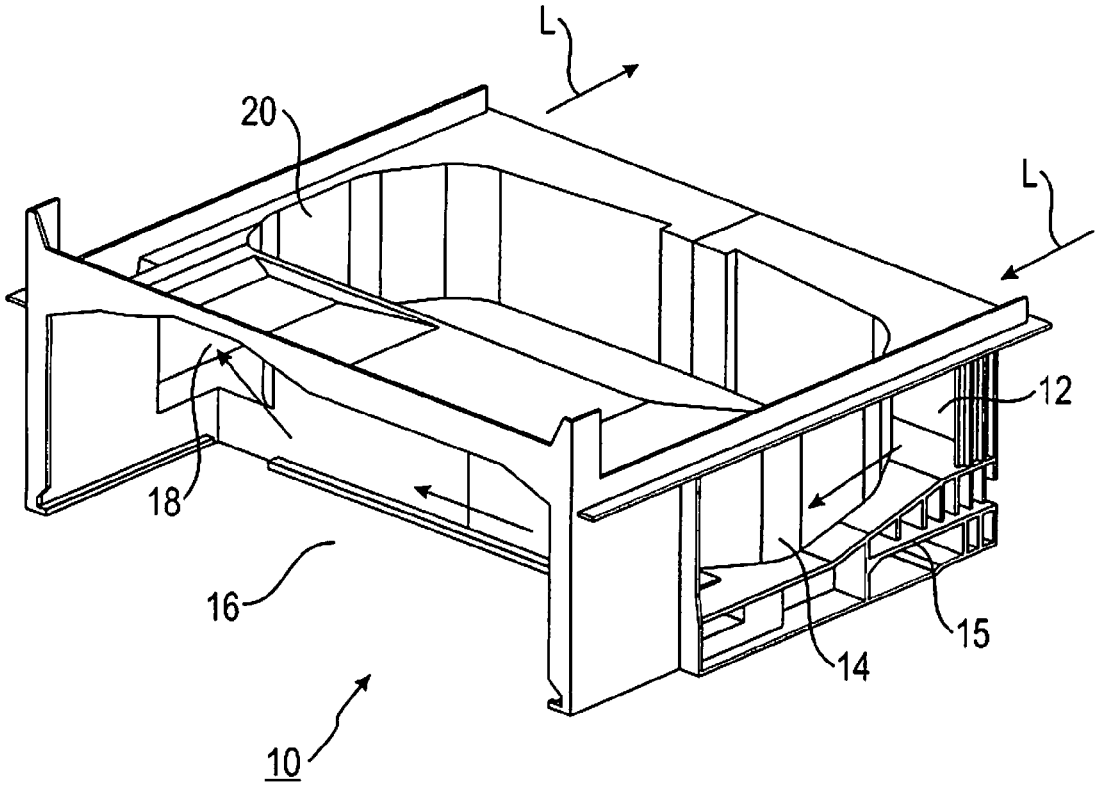
FIG. 1: A perspective rear view of a subassembly.

FIG. 1 shows a perspective rear view of subassembly 10 according to the present invention. The subassembly 10 is designed as a device base 10, which is finished as an injection molded part on one side. In the case of the device base 10, this is an injection molded part made of impact-resistant plastic.

Without being shown in greater detail in FIG. 1, the device base 10 has support surfaces on its lower side by which the device base 10 can be adjusted directly on the floor. Simultaneously or alternatively, threaded holes can be provided into which the leveling feet can be screwed.

The pallet-like device base 10 has a tray-like recess 20 on its top side that is provided for acceptance of the inner receptacle of the refrigerating and/or freezing apparatus.

The air inlet for air L, whose direction of flow through the device base 10 is indicated by means of the corresponding arrow, takes place through the front-side part 12 or air inlet 12 of the air guidance device which is expanded at this location. In the side partial view 14 of the air guidance device or the air guidance channel, the air guidance device or the air guidance channel narrows in width, but expands slightly in height since the floor 15 of the side partial section 14 drops away downward slightly diagonally.

The air L is thus discharged from air inlet 12 essentially horizontally and without an abrupt change in direction from the vertical, is guided through the side partial section 14 of the air guidance channel to the machinery compartment 16 which is formed by the expansion of the air guidance channel in the rear portion of the device base 10.

After the air flows through the machinery compartment 16, the heated air L exits there in the side partial section 18 of the air guidance channel located in the other side, so that the air is guided past recess 20 to the air outlet 19, not seen in FIG. 1.

Figure 2:
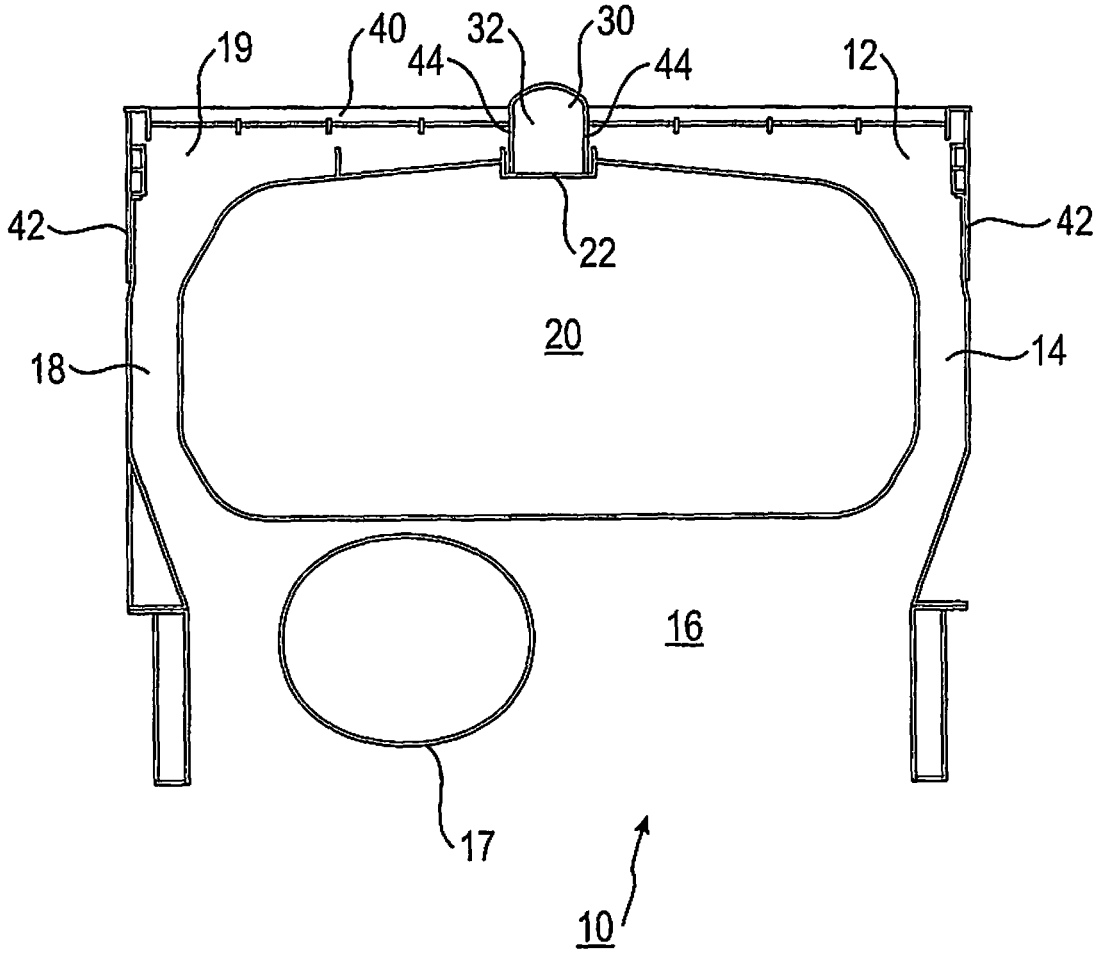
FIG. 2: A schematic top view of a subassembly.

The installation shown in FIG. 1 is shown again schematically in FIG. 2, which represents a schematic top view of the device base 10. Also visible from FIG. 2, the device base 10 can be provided on the front side with a front panel 40 that can be thrust into the device base 10 to adjust the depth by means of side bosses 42. The adjustability and adaptability of the front panel 40 to the respective positioning is ensured. In particular, with built-in devices, a simple depth adjustment can be made.

To separate the air inlet 12 and the air outlet 19 from each other, i.e., particularly to avoid plug flow, an air separator 30 is provided. The air separator 30 can be formed by the corresponding bosses 44 in the front panel 40, which bosses penetrate into a corresponding recess 22 in the device base 10. Alternatively or simultaneously, provision can be made for the air separator 30 to contain an injection molded part 32 that is placed between the bosses 44 and the recess 22 and held there tightly.

Figure 3:
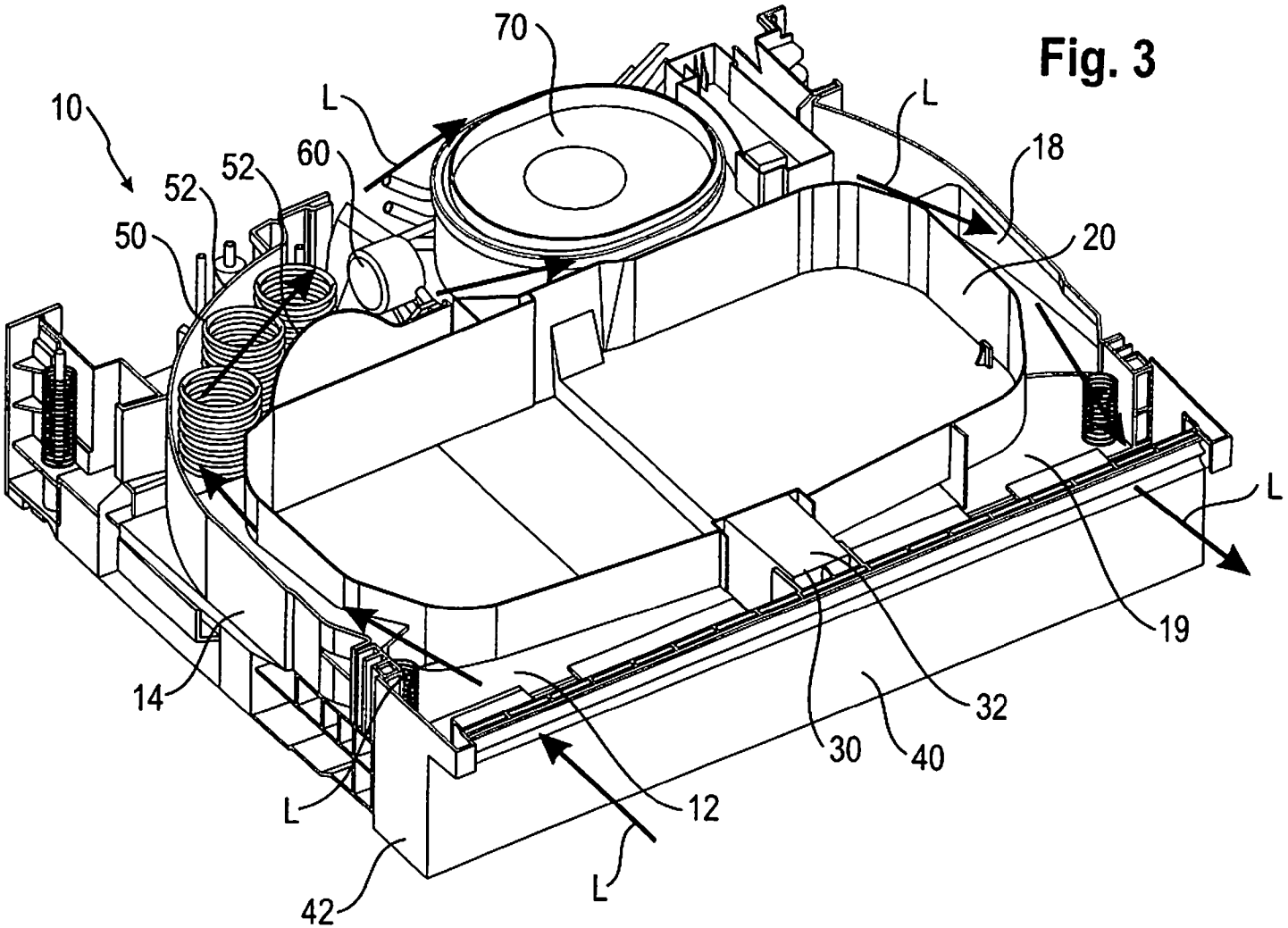
FIG. 3: A perspective view of the subassembly with the assembled components of a refrigerating and/or freezing apparatus.

In the machinery compartment 16, a fastening device 17 is also provided for the compressor 70 (see FIG. 3). The fastening device 17 can be a recess or a retainer in which the compressor 70 can be placed to facilitate simple, quick assembly.

FIG. 3 is a perspective view of the subassembly 10 with assembled components of a refrigerating and/or freezing apparatus, where the method of functioning of device base 10 can be explained in detail based on this Figure.

Cold ambient air L enters through oblique fins in the front panel 40 into the air inlet 12 of the device base 10 and then flows through the side channel 14, which has essentially a rectangular cross-section with a vertical orientation, i.e., it is higher than wide. Due to the slanted floor wall 15 (see FIG. 1), the cross-section widens slightly since channel 14 increases in height.

The air L is guided through channel 14 to the spiral condenser 50 and cools it. To enable an optimal flow around the condenser 50, bent air guidance walls 52 are provided in machinery compartment 16 that surround the vertical spirals of the condenser 50.

Downstream from the condenser 50, a fan 60 is provided that allows the air L to circulate through the device base 10. The fan 60 further loads the compressor 70 with the air L fed past the condenser 50 so that the optimal heat removal from compressor 70 can also be achieved. After the compressor 70, the air L enters into side channel 18 which is installed similarly to side channel 14, and is in particular formed symmetrically to the latter. The air L is fed through the air outlet 19 through side channel 18 and exits there through the fins of the front panel 40.

Based on the vertical orientation of the cross-section of side channels 14 and 18, the actual air flow essentially succeeds in taking place essentially at the exterior part of air inlet 12, while the outflow of the air L heated in the device base 10 takes place at the exterior part of the air outlet 19. The inflowing cold air flow L and the outflowing warm air flow L are thus distanced from each other maximally.

Moreover, the air flow L is fed essentially on a horizontal plane, whereby flow losses can be avoided. The air inlet and air outlet and air guidance in the device base 10 run horizontally on the same plane, where the expansion in side channels 14 and 18 is omitted in this view. Thus, according to the invention, there is no deflection of the air flow from the vertical, which is why the flow resistances remain low. This enables the fan 60 to run at comparatively low speeds so that the noise level in operation can be reduced.

FIG. 3 shows the finished assembled subassembly of a refrigerating and/or freezing apparatus provided for installation in a furniture niche. In the next stage of assembly, this subassembly, consisting of the device base 10 and the components of the cooling circuit assembled in the device base 10 are assembled with the inner receptacle (not shown) and pre-positioned for assembly.

Here, the inner receptacle that has a shape corresponding to the recess 20 is inserted into the recess 20 so that a uniform gap is created on all sides in the recess 20, which gap is intended for foam expansion. This gap is approximately 2 cm and is advantageously adjusted by the corresponding spacers.

After pre-positioning the device base 10 and the inner receptacle, the exterior walls of the refrigerating and/or freezing apparatus are positioned on the device base 10 and the inner receptacle. Then the corresponding gaps between the device base 10, the inner receptacle and the exterior walls is back-foamed, i.e., filled with foam. The device base 10, the inner receptacle and the exterior walls are already connected together merely with this so-called back-foaming. This method of assembly thus facilitates a significantly easier and quicker assembly of the refrigerating and/or freezing apparatus so that the previously common screwing of the heavy subassembly consisting of the base and the components of the cooling circuit located in the base to the body consisting of the previously back-foamed exterior walls and the inner receptacle can be replaced by the back-foaming, which is required in any event.

Figure 4:
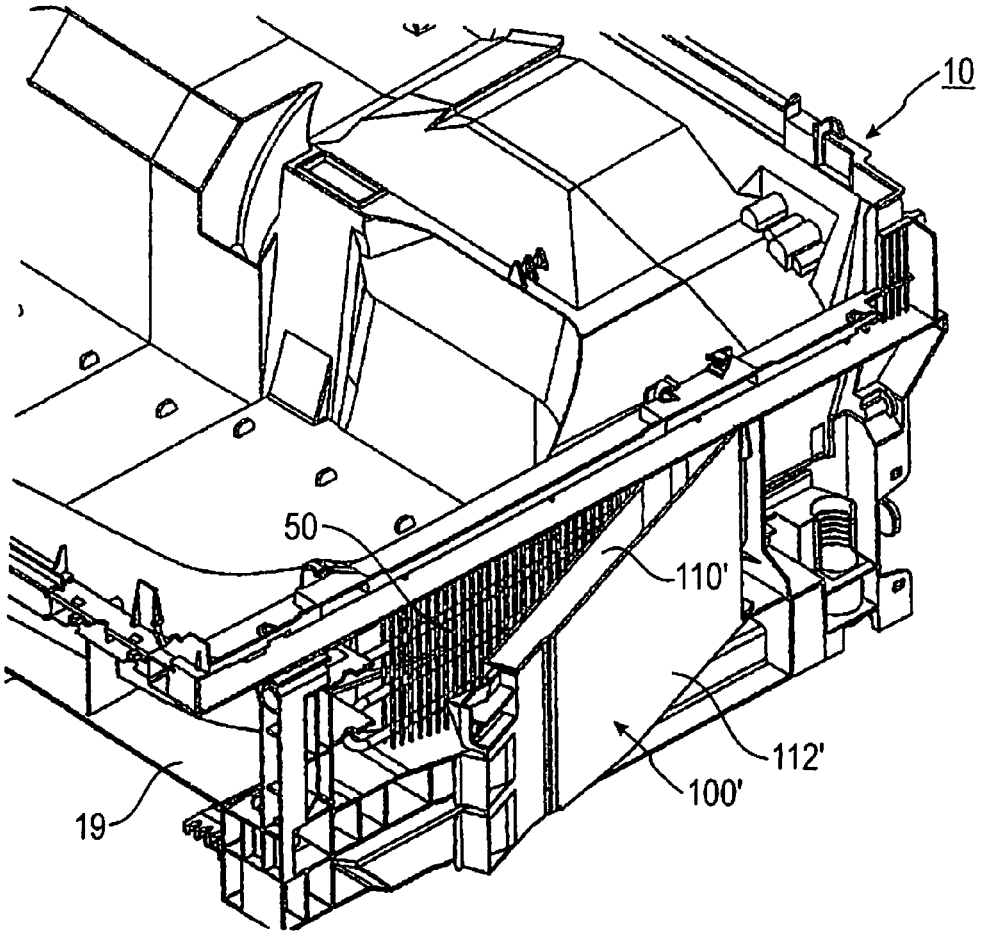
FIG. 4: A perspective view of a subassembly with laterally-removable evaporation tray.

FIG. 4 shows a perspective representation of a part of a subassembly 10 in another embodiment, where the evaporation tray 110' is integrated into a side cover 100' of the subassembly 10 and can be removed from the side and reinserted. The evaporation tray 110' is thus accessible from the front and can accordingly be removed simply for cleaning purposes and then reinserted. The exterior wall 112' of the evaporation tray 110' itself forms the exterior walls of the side cover 100' of the subassembly 10. As also shown in FIG. 4, a condenser 50 is located behind the evaporation tray 110', which can be inserted into the subassembly 10 through the air outlet 19 here.

Figure 5:
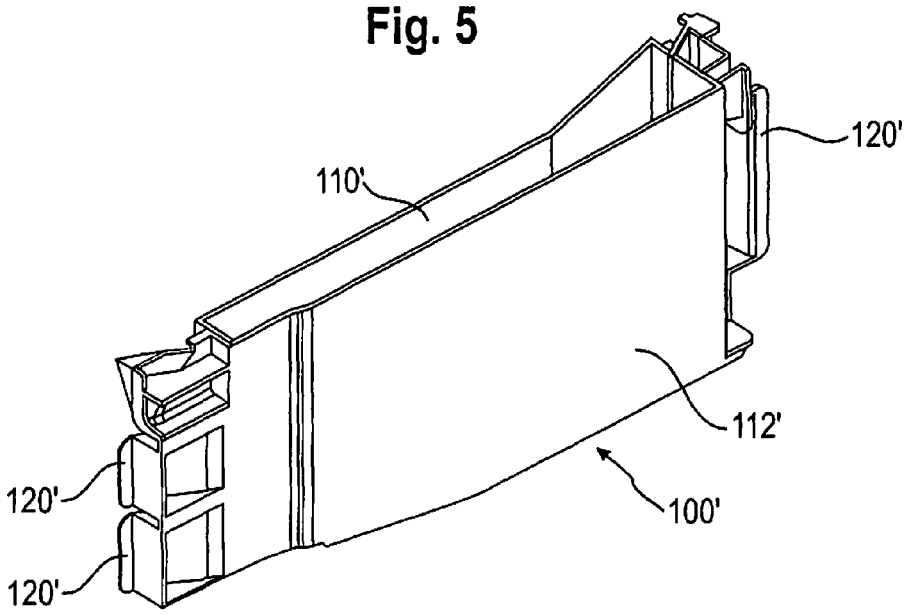
FIG. 5: A perspective view of the evaporation tray.

FIG. 5 shows a perspective representation of the evaporation tray 110' shown in FIG. 4. As shown here, the evaporation tray 110' has several locking components 120' by means of which the evaporation tray 110' can be locked into the subassembly 10.

Figure 6:
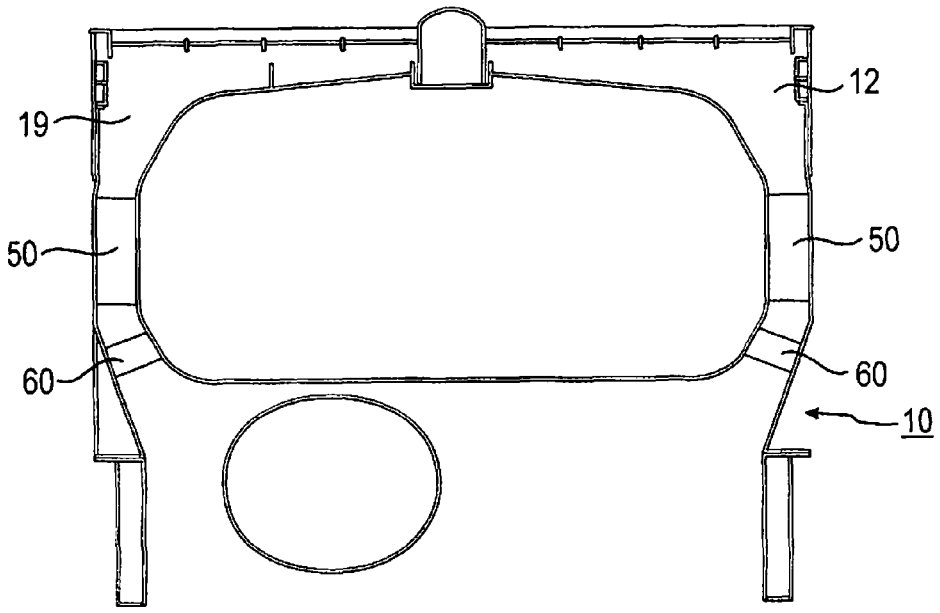
FIG. 6: Another schematic top view of a subassembly.
Figure 7:
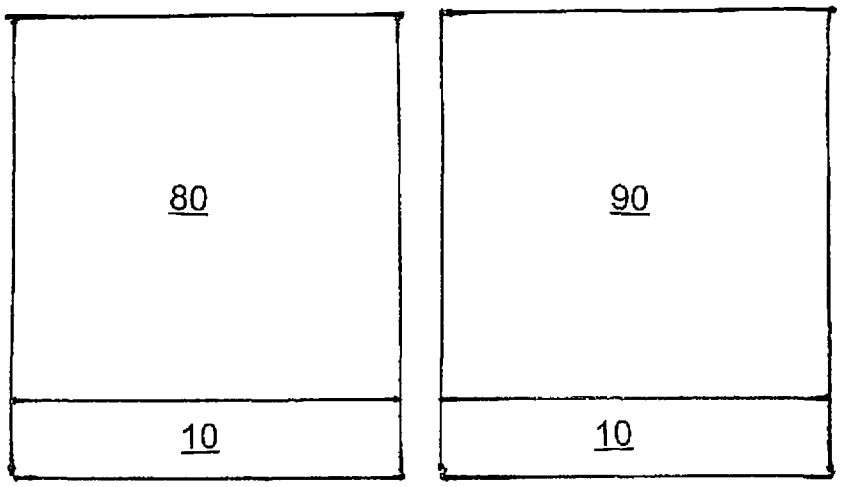
FIG. 7: A schematic view of side by side refrigeration and/or freezing devices.

FIG. 6 shows, in a schematic top view of subassembly 10, how the condenser 50 shown in FIG. 4 is arranged on both sides in the side channels of the subassembly 10 and how it can be inserted respectively on the front side through the air inlet 12 or through the air outlet 19. Each condenser 50 is assigned in each case to a fan 60.

The invention claimed is:

1. A subassembly (10) for a refrigerating and/or freezing apparatus,wherein the subassembly (10) comprises at least one air inlet (12) and at least one air outlet (19) and wherein the subassembly (10) is designed in one piece and where at least one air guidance device is provided in the subassembly (10), that is designed such that the air is guided essentially on a horizontal plane and vertically from the air inlet (12) to the air outlet (19), wherein by means of the air guidance, air is guided into the subassembly (10) without an abrupt change in vertical direction from the air inlet (12) to the air outlet (19) wherein the subassembly (10) has a recess (20) configured to accept and partially surround an inner receptacle of the refrigerating and/or freezing device, wherein the air passes outside the recess and the recess does not contain a condenser.

2. The subassembly (10) of claim 1, wherein deviation of air flow from the horizontal plane is not more than ±30°.

3. The subassembly (10) of claim 1, wherein the air guidance device is arranged at least in part on the edge of the subassembly (10).

4. The subassembly (10) of claim 1, wherein the recess (20) is arranged in the middle or center and/or for the recess (20) is formed in the shape of a tray on the top side of the subassembly (10).

5. The subassembly (10) of claim 1, wherein the air guidance device expands into an accommodating space (16) for at least one compressor (70), at least one fan (60) and at least one condenser (50), wherein fasteners, particularly fasteners for the compressor (70), the fan (60) and the condenser (50), are provided.

6. The subassembly (10) of claim 5, wherein the fasteners for the condenser (50), the fan (60) and the compressor (70) are arranged one after the other in the direction of the flow.

7. The subassembly (10) of claim 1, wherein the air guidance device extends from the air inlet (12), starting laterally past the recess (20) over the: accommodating space (16) located in the rear area of the subassembly (10) and again laterally past the recess (20) to the air outlet (19).

8. The subassembly (10) of claim 1, wherein the air guidance device is formed in the shape of a channel and/or the air guidance device has a round, oval or rectangular crosssection, at least in parts.

9. The subassembly (10) of claim 8, wherein the oval or rectangular cross-section of the air guidance device is constructed vertically.

10. The subassembly (10) of claim 1 wherein the subassembly (10) is a device base (10) and/or an injection molded part.

11. The subassembly (10) of claim 1, wherein a condensation water catch tray (110') or an evaporation tray (110') is provided, wherein the condensation water catch tray (110') or the evaporation tray (110') is arranged in a front area of the subassembly (10) and/or in an area accessible from the front of the subassembly (10).

12. The subassembly (10) of claim 5, wherein the subassembly (10) is formed such that the minimum of one condenser (50) can be inserted into the front side.

13. The subassembly (10) of claim 2, wherein the air guidance device is arranged at least in part on the edge of the subassembly (10).

14. The subassembly (10) of claim 1, wherein by means of the air guidance device, air can be guided into the subassembly (10) without an abrupt change in direction from the air inlet (12) to the air outlet (19), wherein the deviation from the horizontal plane is not more than ±15°.

15. The subassembly (10) of claim 11 wherein its evaporation tray (110') is integrated into a side cover (110) of the subassembly (10) and is removable therefrom.

16. A refrigerating and/or freezing apparatus with at least one subassembly (10) for a refrigerating and/or freezing apparatus, wherein the subassembly (10) comprises at least one air inlet (12) and at least one air outlet (19) and wherein the subassembly (10) is designed in one piece and where at least one air guidance device is provided in the subassembly (10), that is designed such that the air is guided essentially on a horizontal plane and vertically from the air inlet (12) to the air outlet(19), wherein by means of the air guidance device, air is guided into the subassembly (10) without an abrupt change in vertical direction from the air inlet (12) to the air outlet (19), wherein the subassembly (10) has a recess (20) configured to accept and at least partially surround an inner receptacle of the refrigerating and/or freezing device, wherein the air passes outside the recess and the recess does not contain a condenser.

17. The refrigerating and/or freezing apparatus of claim 16, wherein the refrigerating and/or freezing apparatus is a side-by-side device.

18. The refrigerating and/or freezing apparatus of claim 17, wherein the devices arranged side by side in a side-by-side device each have one subassembly (10) and the subassemblies (10) are formed and/or usable in mirrored fashion.

19. A subassembly (10) for a refrigerating and/or freezing apparatus, wherein the subassembly (10) comprises at least one air inlet (12) and at least one air outlet (19) and wherein the subassembly (10) is designed in one piece and where at least one air guidance device is provided in the subassembly (10), that is designed such that the air is guided essentially on a horizontal plane, wherein a condensation water catch tray (110') or an evaporation tray (110') is provided, wherein the condensation water catch tray (110') or the evaporation tray (110') is arranged in a front area of the subassembly (10) and/or in an area accessible from the front of the subassembly (10), wherein its evaporation tray (110') is integrated into a side cover (110) of the subassembly (10) and is removable therefrom, wherein the evaporation tray (110') has at least one locking component (120') for locking the evaporation tray (110') into the subassembly (10).

20. A subassembly (10) for a refrigerating and/or freezing apparatus, wherein the subassembly (10) comprises at least one air inlet (12) and at least one air outlet (19) and wherein the subassembly (!0) is designed in one piece and where at least one air guidance device is provided in the subassembly (10), that is designed such that the air is guided essentially on a horizontal plane and vertically from the air inlet (12) to the air outlet (19), wherein by means of the air guidance device, air is guided into the subassembly (10) without an abrupt change in vertical direction from the air inlet (12) to the air outlet (19), wherein the subassembly (10) has a recess (20) configured to accept and at least partially surround an inner receptacle of the refrigerating and/or freezing device, wherein the air passes outside the recess and the recess does not contain a condenser.

* * * * *